US010640723B2

(12) United States Patent
Fang

(10) Patent No.: US 10,640,723 B2
(45) Date of Patent: May 5, 2020

(54) LUBRICANTS CONTAINING AMINE SALT OF ACID PHOSPHATE AND HYDROCARBYL BORATE

(71) Applicant: Afton Chemical Corporation, Richmond, VA (US)

(72) Inventor: Xinggao Fang, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 131 days.

(21) Appl. No.: 15/923,435

(22) Filed: Mar. 16, 2018

(65) Prior Publication Data

US 2019/0284496 A1 Sep. 19, 2019

(51) Int. Cl.

| | |
|---|---|
| ***C10M 173/02*** | (2006.01) |
| ***C10M 159/12*** | (2006.01) |
| ***C10M 141/12*** | (2006.01) |
| ***C10M 107/02*** | (2006.01) |
| ***C10M 133/06*** | (2006.01) |
| ***C10M 137/04*** | (2006.01) |
| *C10N 30/04* | (2006.01) |
| *C10N 30/10* | (2006.01) |
| *C10N 30/12* | (2006.01) |

(52) U.S. Cl.

CPC ..... *C10M 141/12* (2013.01); *C10M 107/02* (2013.01); *C10M 133/06* (2013.01); *C10M 137/04* (2013.01); *C10M 2215/02* (2013.01); *C10M 2215/04* (2013.01); *C10M 2215/28* (2013.01); *C10M 2223/043* (2013.01); *C10M 2227/061* (2013.01); *C10N 2030/04* (2013.01); *C10N 2030/10* (2013.01); *C10N 2030/12* (2013.01); *C10N 2230/06* (2013.01); *C10N 2240/04* (2013.01); *C10N 2240/042* (2013.01); *C10N 2240/045* (2013.01); *C10N 2260/12* (2013.01); *C10N 2260/14* (2013.01)

(58) Field of Classification Search

CPC ..... C10M 125/26; C10M 137/08
USPC ..... 508/156, 162, 188
See application file for complete search history.

(56) References Cited

U.S. PATENT DOCUMENTS

| | | | | |
|---|---|---|---|---|
| 2,063,629 | A | 12/1936 | Salzberg et al. | |
| 2,224,695 | A | 12/1940 | Prutton | |
| 2,447,288 | A | 8/1948 | Smith et al. | |
| 2,616,905 | A | 11/1952 | Asseff et al. | |
| 3,502,677 | A * | 3/1970 | Sner | C07F 9/02 544/243 |
| 3,984,448 | A | 10/1976 | Lippsmeier | |
| 4,029,588 | A | 6/1977 | Koch | |
| 4,431,552 | A | 2/1984 | Salentine | |
| 4,557,844 | A | 12/1985 | Horodysky | |
| 4,943,672 | A | 7/1990 | Hammer et al. | |
| 5,344,579 | A | 9/1994 | Ohtani et al. | |
| 5,354,484 | A | 10/1994 | Schwind et al. | |
| 5,389,452 | A | 2/1995 | Nakajima et al. | |
| 5,763,372 | A * | 6/1998 | Tersigni | C10M 141/10 508/291 |
| 5,882,505 | A | 3/1999 | Wittenbrink et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,180,575 | B1 | 1/2001 | Nipe | |
| 6,548,458 | B2 | 4/2003 | Loper | |
| 7,732,390 | B2 | 6/2010 | Kadkhodayan et al. | |
| 2005/0014656 | A1 | 1/2005 | Sumiejski et al. | |
| 2006/0252656 | A1 | 11/2006 | Zakarian et al. | |
| 2006/0252657 | A1 | 11/2006 | Zakarian et al. | |
| 2008/0020952 | A1 * | 1/2008 | Yagishita | C10M 139/00 508/186 |
| 2008/0200357 | A1 | 8/2008 | Chasan et al. | |
| 2010/0173808 | A1 | 7/2010 | Chasan et al. | |
| 2012/0101017 | A1 | 4/2012 | Duggal | |

FOREIGN PATENT DOCUMENTS

| | | | |
|---|---|---|---|
| CN | 1232080 | A | 10/1999 |
| CN | 102977971 | A | 3/2013 |
| CN | 103468389 | B | 10/2014 |
| CN | 102776052 | B | 12/2014 |
| CN | 104263492 | A | 10/2015 |
| FR | 2904326 | A1 | 2/2008 |
| FR | 2904327 | A1 | 2/2008 |
| JP | 5037494 | B2 | 9/2012 |
| JP | 5204625 | B2 | 6/2013 |
| JP | 5473325 | B2 | 4/2014 |
| KR | 100437554 | B1 | 6/2004 |
| KR | 1020100135218 | A | 12/2010 |
| WO | WO8707638 | A2 | 12/1987 |
| WO | 2004007652 | A1 | 1/2004 |
| WO | 2008095805 | A2 | 8/2008 |
| WO | 2016089565 | A1 | 6/2016 |

OTHER PUBLICATIONS

Extended European Search Report for corresponding European Application No. 19162686.0; dated Aug. 30, 2019; (7 pages).

* cited by examiner

*Primary Examiner* — Prem C Singh
*Assistant Examiner* — Francis C Campanell
(74) *Attorney, Agent, or Firm* — Mendelsohn Dunleavy, P.C.

(57) ABSTRACT

A lubricating oil composition including greater than 50 wt. % of a base oil; a reaction product of a hydrocarbyl acid phosphate and a nitrogen containing compound; and an oil soluble hydrocarbyl borate. A method for reducing gear scuffing in a transmission including a step of lubricating the transmission with the above-mentioned lubricating oil composition and a method of operating a transmission including steps of lubricating said transmission with the lubricating oil composition described above and operating the transmission, are also described.

36 Claims, No Drawings

LUBRICANTS CONTAINING AMINE SALT OF ACID PHOSPHATE AND HYDROCARBYL BORATE

TECHNICAL FIELD

The disclosure relates to lubricating oils containing a reaction product of a hydrocarbyl acid phosphate with a nitrogen containing compound and an oil soluble hydrocarbyl borate. More specifically, the disclosure relates to lubricating oil compositions containing a reaction product of a hydrocarbyl acid phosphate with a nitrogen containing compound, and an oil soluble hydrocarbyl borate for lubrication of a transmission to provide one or more of improved wear protection and corrosion resistance.

BACKGROUND

Advanced vehicle technologies demand improved protection of transmission, gear and axle hardware. Conventional transmission, gear, and axle lubricants contain relatively high concentrations of sulfur containing lubricant additives are commonly used as anti-wear and extreme pressure additives to protect hardware. Unfortunately, these anti-wear and extreme pressure additives often provide variable protection while introducing undesirable consequences. For example, sophisticated electronic components, as well as rubber seals, can fail prematurely because of interactions with sulfur-containing compounds. As a result, new standards are expected for transmission, gear and axle lubricants, including dual clutch transmissions, continuously variable transmissions, electric transmissions and hybrid transmissions. The new standards are expected to require lower sulfur concentrations in the lubricants. Thus, there is a need for sufficient hardware protection without relying on harmful sulfur-containing additives.

It would be desirable to reduce or eliminate sulfur from lubricant compositions. Boron-containing compounds can provide anti-wear protection that may improve on gear scuffing. For example, in some cases boric acid is used as an anti-wear component. However, boric acid suffers from the disadvantage that it is not oil soluble and thus special steps, such as capping a dispersant with boric acid, must be taken in the lubricant manufacturing process to dissolve boric acid in the lubricant composition.

The present disclosure seeks to reduce or eliminate sulfur from the lubricant composition while providing simplified manufacturing process that does not require dissolution of oil insoluble components such as boric acid into the lubricant. In addition, the present disclosure provides lubricant additive combinations that have improved performance relative to lubricant compositions that employ boric acid-capped dispersants. In addition, the lubricant additive combinations of the present invention can be used at relatively lower treat rates.

A lubricating composition with improved storage stability comprising a major amount of an oil of lubricating viscosity, at least one alkali metal borate, at least one polysulfide mixture having at least 40% dihydrocarbyl tetrasulfide or higher sulfides, and at least one non-acidic phosphorus compound comprised of a trihydrocarbyl phosphate and a dihydrocarbyl dithiophosphate derivative is disclosed in US 2006/0252656 A1. Similarly, a lubricating oil composition having improved storage stability and load-carrying effect is disclosed in US 2006/0252657 A1. The composition comprises four components: (1) an alkali metal borate; (2) an oil-soluble sulfur compound; (3) a trialkyl phosphite; and (4) a mixture of greater than 50% neutralized acidic phosphates that are essentially free of monothiophosphates. These compositions suffer from the disadvantage of employing oil insoluble alkali metal borates.

Many of the additives used in transmission, gear and axle lubricants are multifunctional and there is often a conflict generated between properties, such as the scuffing load capacity, copper corrosion performance and bearing pitting performance. These conflicts inevitably mean that additives must be carefully selected and balanced. Accordingly, it has proven difficult for additive companies to meet performance requirements, much less improve significantly on any of the performance thresholds.

An object of the present disclosure is to provide an alternative to sulfur containing compounds by combining an amine salt of a hydrocarbyl acid phosphate and an oil-soluble borate to provide improved wear protection for lubrication of transmissions. The disclosure may provide a lubricant composition that has one or more of an improved scuffing load capacity as well as uses of and methods of using the lubricating composition to lubricate a transmission and/or reduce gear scuffing.

SUMMARY AND TERMS

As set forth above, the present disclosure relates to a lubricating oil composition generally comprising a) greater than 50 wt. % of a base oil; b) 0.01 wt. % to 10 wt. % of a reaction product of a hydrocarbyl acid phosphate of the formula (I), based on the total weight of the lubricating oil composition:

(I)

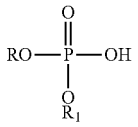

wherein R is a hydrocarbyl group having 1 to 20 carbon atoms and $R_1$ is selected from hydrogen and a hydrocarbyl group having 1 to 20 carbon atoms, and a nitrogen containing compound, wherein the nitrogen containing compound is selected from:

i) an oil soluble amine of the formula (II):

(II)

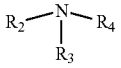

wherein $R_2$ and $R_3$ are each independently selected from hydrogen or a hydrocarbyl group having from 1 to 20 carbon atoms, and $R_4$ is a hydrocarbyl group having 1 to 20 carbon atoms;

ii) an oil soluble amine of the formula (III):

(III)

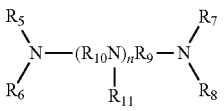

wherein $R_5$, $R_6$, $R_7$, $R_8$, and $R_{11}$ are each independently selected from hydrogen and a hydrocarbyl group containing from 1 to 160 carbon atoms; $R_9$ and $R_{10}$ are independently selected from hydrocarbylene groups containing from 2 to 20 carbon atoms; n is an integer of from 0 to 20 and when n>1, each $R_{10}$ can be the same or different and each $R_{11}$ can be the same or different; and iii) a hydrocarbyl substituted-succinimide; and c) an oil soluble hydrocarbyl borate of the formula (IV), based on the total weight of the lubricating oil composition:

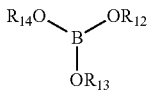

(IV)

wherein $R_{12}$, $R_{13}$, and $R_{14}$ are each independently selected from a hydrocarbon group containing from 1 to 20 carbon atoms, and wherein the hydrocarbyl borate of the formula (IV) contains at least 6 carbon atoms.

In each of the foregoing embodiments, the lubricating oil composition may have a molar ratio of moles of phosphorus contributed by component b) to moles of boron contributed by component c) of from 1:1 to 10:1, or from 1.3:1 to 6:1, or from 1.4:1 to 5.75:1.

In each of the foregoing embodiments, $R_{12}$, $R_{13}$, and $R_{14}$ may be independently selected from linear alkyl, branched alkyl, and cycloalkyl.

In each of the foregoing embodiments, the hydrocarbyl borate component c) may be selected from triethyl borate and tributyl borate.

In each of the foregoing embodiments, the hydrocarbyl acid phosphate may be selected from the group consisting of amyl acid phosphate, methyl acid phosphate, hexyl acid phosphate, 2-ethyl hexyl acid phosphate. Preferably, the hydrocarbyl acid phosphate may be selected from the group consisting of amyl acid phosphate, methyl acid phosphate, and hexyl acid phosphate.

In each of the foregoing embodiments, the hydrocarbyl acid phosphate may be employed as a reactant to make component (b) in an amount of 0.01 wt. % to 5 wt. %, or from 0.1 wt. % to 2 wt. %, or from 0.15 wt. % to 1.5 wt. %, based on the total weight of the lubricating oil composition.

In each of the foregoing embodiments, the nitrogen containing compound may be selected from an amine of the formula (II) containing at least 8 carbon atoms.

In each of the foregoing embodiments, component b) may be present in an amount of from 0.1 wt. % to 5 wt. %, or from 0.5 wt. % to 4 wt. %, or from 0.75 wt. % to 3.75 wt. %, based on the total weight of the lubricating oil composition.

In each of the foregoing embodiments, component b) may be present in an amount to contribute from 50 ppm to 1500 ppm of phosphorus, based on the total weight of the lubricating oil composition, or in each of the foregoing embodiments, component b) may be present in an amount to contribute from 300 ppm to 1500 ppm of phosphorus, based on the total weight of the lubricating oil composition or in each of the foregoing embodiments, component b) may be present in an amount to contribute from 900 ppm to 1200 ppm of phosphorus, based on the total weight of the lubricating oil composition In each of the foregoing embodiments, component c) may be present in an amount to contribute from 5 ppm to 400 ppm of boron, based on the total weight of the lubricating oil composition, or in each of the foregoing embodiments, component c) may be present in an amount to contribute from 10 ppm to 350 ppm of boron, based on the total weight of the lubricating oil composition, or in each of the foregoing embodiments, component c) may be present in an amount to contribute from 55 ppm to 375 ppm of boron, based on the total weight of the lubricating oil composition.

In each of the foregoing embodiments, a molar ratio of the acid phosphate component to the nitrogen containing compound of from 0.2:0.8 may be employed to make component b), or in each of the foregoing embodiments, a molar ratio of the acid phosphate component to the nitrogen containing compound of from 0.4:0.7 may be employed to make component b).

In each of the foregoing embodiments, R may be a hydrocarbyl group comprising from 1 to 10 carbon atoms, or from 1 to 6 carbon atoms; and $R_1$ may be selected from hydrogen and a hydrocarbyl group comprising from 1 to 10 carbon atoms.

In each of the foregoing embodiments, R may be a hydrocarbyl group comprising from 1 to 6 carbon atoms, and $R_1$ may be hydrogen.

In each of the foregoing embodiments, the nitrogen containing compound may be selected from amines of the formula (II) wherein $R_2$ is hydrogen or wherein $R_2$ and $R_3$ are hydrogen, or in each of the foregoing embodiments, the nitrogen containing compound may be selected from amines of the formula (III) wherein n=0, and $R_9$ is a hydrocarbylene group comprising from 2 to 20 carbon atoms, or in each of the foregoing embodiments, the nitrogen containing compound may be selected from amines of the formula (II) wherein n is from 2 to 5, $R_5$-$R_8$ and $R_{11}$ are hydrogen, and $R_9$ and $R_{10}$ are hydrocarbylene groups comprising 2 carbon atoms, or in each of the foregoing embodiments, the nitrogen containing compound may be selected from the group consisting of mono-alkenylsuccinimides, bis-alkenylsuccinimides, and polyisobutylene succinimides, or in each of the foregoing embodiments, the nitrogen containing compound may be a mono-alkenylsuccinimide prepared by reacting octadecenyl succinic anhydride and tetraethylenepentamine.

In each of the foregoing embodiments, the base oil may be selected from a Group II base oil having at least 90% saturates, a Group III base oil having at least 90% saturates, a Group IV base oil, a Group V base oil or a mixture of two or more of these base oils, or in each of the foregoing embodiments, the base oil may be a Group III base oil, or in each of the foregoing embodiments, the base oil may be a Group IV base oil, or in each of the foregoing embodiments, the base oil may be a Group V base oil, or in each of the foregoing embodiments, the base oil may be a mixture of two or more of a Group III base oil, a Group IV base oil and a Group V base oil.

In each of the foregoing embodiments, the composition may further comprise an ashless dispersant. In these embodiments, the ashless dispersant may be borated and/or phosphorylated.

In each of the foregoing embodiments, the composition may further comprise one or more of the optional components selected from the group consisting of detergents, corrosion inhibitors, antioxidants, viscosity modifiers and friction modifiers.

In each of the foregoing embodiments, the lubricating composition may be a transmission fluid.

In each of the foregoing embodiments, the lubricating composition may be a gear oil.

In another embodiment, the present invention is directed to methods for reducing gear scuffing in a transmission comprising a step of lubricating the transmission with any one of the foregoing lubricating oil compositions, In another embodiment, the present invention is directed to a method of operating a transmission comprising the step of lubricating the transmission with any one of the foregoing lubricating oil compositions.

Additional features and advantages of the disclosure may be set forth in part in the description which follows, and/or may be learned by practice of the disclosure. The features and advantages of the disclosure may be further realized and attained by means of the elements and combinations particularly pointed out in the appended claims.

It is to be understood that both the foregoing general description and the following detailed description are exemplary and explanatory only and are not restrictive of the disclosure, as claimed.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant" and "transmission fluid, " refer to a finished lubrication product comprising a major amount of a base oil plus a minor amount of an additive composition.

As used herein, the terms "additive package," "additive concentrate," "additive composition," and "transmission fluid additive package" refer the portion of the lubricating oil composition excluding the major amount of base oil stock mixture.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties of from about 1 to about 200 carbon atoms.

The term "alkenyl" as employed herein refers to straight, branched, cyclic, and/or substituted unsaturated chain moieties of from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

The term "hydrocarbylene group" as employed herein refers to a diradical formed by removal of one hydrogen atom from each of two different carbons of a hydrocarbon.

A "functional fluid" is a term which encompasses a variety of fluids including but not limited to tractor hydraulic fluids, power transmission fluids including automatic transmission fluids, continuously variable transmission fluids, manual transmission fluids, electric vehicle fluids, and hybrid transmission vehicle fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Disclosed herein is a lubricating oil composition including:

a) greater than 50 wt. % of a base oil;

b) 0.01 wt. % to 10 wt. % of a reaction product of a hydrocarbyl acid phosphate of the formula (I), based on the total weight of the lubricating oil composition:

(I)

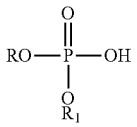

wherein R is a hydrocarbyl group having 1 to 20 carbon atoms and $R_1$ is selected from hydrogen and a hydrocarbyl group having 1 to 20 carbon atoms, and a nitrogen containing compound, wherein the nitrogen containing compound is selected from:

i) an oil soluble amine of the formula (II):

(II)

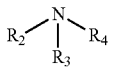

wherein $R_2$ and $R_3$ are each independently selected from hydrogen or a hydrocarbyl group having from 1 to 20 carbon atoms, and $R_4$ is a hydrocarbyl group having 1 to 20 carbon atoms; and ii) an oil soluble amine of the formula (III):

(III)

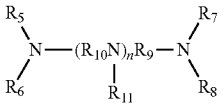

wherein $R_5$, $R_6$, $R_7$, $R_8$, and $R_{11}$ are each independently selected from hydrogen and a hydrocarbyl group containing from 1 to 160 carbon atoms; $R_9$ and $R_{10}$ are independently selected from hydrocarbylene groups containing from 2 to 20 carbon atoms; n is an integer of from 0 to 20 and when n>1, each $R_{10}$ can be the same or different and each $R_{11}$ can be the same or different; and iii) a hydrocarbyl-substituted succinimide that comprises at least one amine group; and c) an oil soluble hydrocarbyl borate of the formula (IV):

(IV)

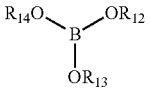

wherein $R_{12}$, $R_{13}$, and $R_{14}$ are each independently selected from a hydrocarbyl group containing from 1 to 20 carbon atoms, and wherein the hydrocarbyl borate of the formula (IV) contains at least 6 carbon atoms.

The Base Oil

Base oils suitable for use in formulating lubricating oils such as transmission fluid compositions, gear oils and axle lubricants according to the disclosure may be selected from any of suitable synthetic or natural oils or mixtures thereof having a suitable lubricating viscosity. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil may have a viscosity of 2 to 15 cSt or, as a further example, 2 to 10 cSt at 100° C. Further, oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500-1000, diethyl ether of polypropylene glycol having a molecular weight of 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di-(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the transmission fluid compositions as described herein may be a single base oil or may be a mixture of two or more base oils. In particular, the one or more base oil(s) may desirably be selected from any of the base oils in Groups I-V as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

In one variation, in each of the foregoing embodiments, the base oil may be selected from a Group II base oil having at least 90% saturates, a Group III base oil having at least 90% saturates, a Group IV base oil, a Group V base oil or a mixture of two or more of these base oils. Alternatively, the base oil may be a Group III base oil, or a Group IV base oil, or a Group V base oil, or the base oil may be a mixture of two or more of a Group III base oil, a Group IV base oil and a Group V base oil.

The base oil may contain a minor or major amount of a poly-alpha-olefin (PAO). Typically, the poly-alpha-olefins are derived from monomers having from 4 to 30, or from 4 to 20, or from 6 to 16 carbon atoms. Examples of useful PAOs include those derived from octene, decene, mixtures thereof, and the like. PAOs may have a viscosity of from 2 to 15, or from 3 to 12, or from 4 to 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide multi-vehicle transmission fluid compositions. Accordingly, the base oil may be present in the fluid composition described herein in an amount ranging from more than 30 wt. % to 95 wt. %, for example, from 40 wt. % to 90 wt. %, and more than 50 wt. % based on a total weight of the lubricating oil composition.

Reaction Product of a Nitrogen Containing Compound and a Hydrocarbyl Acid Phosphate The lubricating composition contains from 0.01 wt. % to 10 wt. % of a reaction product of a nitrogen-containing compound and an acid phosphate. These reaction products may be salts of at least one hydrocarbylamine and at least one hydrocarbyl acid phosphate. Examples of such salts can include oil-soluble amine salts of a phosphoric acid ester, such as those taught in U.S. Pat. Nos. 5,354,484 and 5,763,372, the disclosures of which are hereby incorporated by reference. The amine salts of a phosphoric acid ester can be prepared by reacting a phosphoric acid ester with an amine or ammonia. The salts can be formed separately, and then the salt of the phosphoric acid ester can be added to the lubricating composition.

The amine salts of the present disclosure can be prepared by the reaction of a hydrocarbyl acid phosphate represented by the Formula (I) with at least one amine compound selected from amines of the Formulas (II) and (III). For example, the oil-soluble amine salts can be prepared by mixing the phosphoric acid esters with the amines at room temperature or above. Generally, mixing at room temperature for a period of from up to about one hour is sufficient. The amount of amine reacted with the phosphoric acid ester to form the salts of the disclosure is at least one equivalent weight of the amine (based on nitrogen) per equivalent of phosphoric acid, and the ratio of equivalents generally is about one.

Methods for the preparation of such amine salts are well known and reported in the literature. See for example, U.S. Pat. Nos. 2,063,629; 2,224,695; 2,447,288; 2,616,905; 3,984,448; 4,431,552; 5,354,484; Pesin et al, Zhurnal Obshchei Khimii, Vol, 31 No. 8, pp. 2508-2515 (1961); and PCT International Application Publication No. WO 87/07638, the disclosures of all of which are hereby incorporated by reference.

Alternatively, the salts can be formed in situ when the acidic phosphoric acid ester is blended with the above-described amines when forming an additive concentrate or the fully formulated composition itself.

The amine salt of a hydrocarbyl acid phosphate may be present in an amount sufficient to contribute from 50 to 1500 ppm of phosphorus, or from 300 to 1500 ppm of phosphorus, or from 900 to 1200 ppm of phosphorus, based on a total weight of the lubricating oil composition.

The Hydrocarbyl Acid Phosphate

The hydrocarbyl acid phosphates used to make the reaction product component (b) of the present disclosure are represented by the formula (I):

(Formula I)

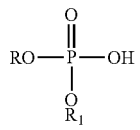

wherein R is a hydrocarbyl group having 1 to 20 carbon atoms and $R_1$ is selected from hydrogen and a hydrocarbyl group having 1 to 20 carbon atoms.

In one aspect, R is a hydrocarbyl group having from 1 to 10 carbon atoms, and $R_1$ is selected from hydrogen and a hydrocarbyl group having from 1 to 10 carbon atoms. In another aspect, R and $R_1$ are independently selected from a hydrocarbyl group having from 1 to 8 carbon atoms. In another aspect, R is selected from a hydrocarbyl group having from 1 to 6 carbon atoms and $R_1$ is selected from hydrogen and a hydrocarbyl group having from 1 to 6 carbon atoms. In another aspect, R is a hydrocarbyl group having from 1 to 6 carbon atoms, and $R_1$ is hydrogen.

An exemplary method of preparing compounds of the formula (I) comprises reacting at least one hydroxy compound of the formula ROH with a phosphorus compound of the formula $P_2O_5$ wherein R can be a hydrocarbyl group. The phosphorus compounds obtained in this manner can be mixtures of phosphorus compounds, and are generally mixtures of mono- and dihydrocarbyl-substituted phosphoric acids.

The hydroxy compound used in the preparation of the phosphoric acid esters of this disclosure can be characterized by the formula ROH wherein R can be a hydrocarbyl group. The hydroxy compound reacted with the phosphorus compound can comprise a mixture of hydroxy compounds of the formula ROH wherein the hydrocarbyl group R can contain from about 1 to about 30 carbon atoms. It is necessary, however, that the amine salt of the substituted phosphoric acid ester ultimately prepared is soluble in the lubricating compositions of the present disclosure. Generally, the R group will contain at least about 1 carbon atoms, for example about 1 to about 30 carbon atoms.

The R group can be aliphatic or aromatic such as alkyl, aryl, alkaryl, and alicyclic hydrocarbon groups. Non-limiting examples of useful hydroxy compounds of the formula ROH include, for example, ethyl alcohol, iso-propyl, n-butyl alcohol, amyl alcohol, hexyl alcohol, 2-ethyl-hexyl alcohol, nonyl alcohol, dodecyl alcohol, stearyl alcohol, amyl phenol, octyl phenol, nonyl phenol, methyl cyclohexanol, and alkylated naphthol, etc.

In an aspect, the alcohols, ROH, can be aliphatic alcohols and for example, primary aliphatic alcohols containing at least about 4 carbon atoms. Accordingly, examples of the exemplary monohydric alcohols ROH which can be useful in the present disclosure include, amyl alcohol, 1-octanol, 1-decanol, 1-dodecanol, 1-tetradecanol, 1-hexadecanol, 1octadecanol, 2-methyl butanol, and 2-methyl-1-propanol, oleyl alcohol, linoleyl alcohol, linolenyl alcohol, phytol, myricyl alcohol, lauryl alcohol, myristyl alcohol, cetyl alcohol, stearyl alcohol and behenyl alcohol.

In another aspect, ROH can be secondary aliphatic alcohols containing at least about 4 carbon atoms. Accordingly, non-limiting examples of secondary aliphatic alcohols include isopropanol, isooctanol, 2-butanol, and methyl isobutyl carbinol (4-methyl-1-pentane-2-ol). Commercial alcohols (including mixtures) are contemplated herein, and these commercial alcohols can comprise minor amounts of alcohols which, although not specified herein, do not detract from the major purposes of this disclosure.

In a further aspect, mixtures of alcohols can be used, including but not limited to mixtures of primary alcohols, mixtures of secondary alcohols, and mixtures of primary/secondary alcohols.

The molar ratio of the hydroxy compound ROH to phosphorus reactant $P_2X_5$ in the reaction can be within the range of from about 1:1 to about 4:1, for example about 3:1.

The reaction can be effected simply by mixing the two reactants at an elevated temperature such as temperatures above about 50° C. up to the composition temperature of any of the reactants or the desired product. In an aspect, the temperature can range from about 50° C. to about 150° C., and can be most often below about 100° C. The reaction can be carried out in the presence of a solvent which facilitates temperature control and mixing of the reactants. The solvent can be any inert fluid substance in which either one or both reactants are soluble, or the product is soluble. Such solvents include benzene, toluene, xylene, n-hexane, cyclohexane, naphtha, diethyl ether carbitol, dibutyl ether dioxane, chlorobenzene, nitrobenzene, carbon tetrachloride or chloroform.

The product of the above reaction is acidic, but its chemical constitution is not precisely known. Evidence indicates, however, that the product is a mixture of acidic phosphates comprising predominantly of the mono- and di-esters of phosphoric acid, the ester group being derived from the alcohol ROH. For example, the hydrocarbyl acid phosphate may be a mixture of:

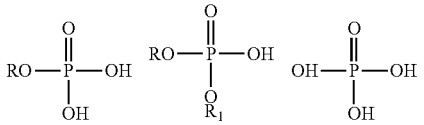

| 45-55% | 45-55% | 0.1-3% |
|---|---|---|
| 40-60% | 40-60% | 0 |

wherein R and $R_1$ are as described above.

Preferred hydrocarbyl acid phosphates include, amyl acid phosphate, methyl acid phosphate, hexyl acid phosphate, and 2-ethyl hexyl acid phosphate. More preferably, the hydrocarbyl acid phosphates include, amyl acid phosphate, methyl acid phosphate, and hexyl acid phosphate.

In some embodiments, the hydrocarbyl acid phosphate may be employed as a reactant to make component (b) in an amount of 0.01 wt. % to 5 wt. %, or from 0.1 wt. % to 2 wt. %, or from 0.15 wt. % to 1.5 wt. %, based on the total weight of the lubricating oil composition.

The Nitrogen Containing Compound

According to the present disclosure, any suitable amine or polyamine containing one or more of a primary, secondary or tertiary amino group, or hydrocarbyl substituted succinimide may be used to make the reaction product (b). In one embodiment, the amine may be an amine of the formula (II):

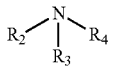

(II)

wherein $R_2$ and $R_3$ are each independently selected from hydrogen or a hydrocarbyl group having from 1 to 20 carbon atoms, and $R_4$ is a hydrocarbyl group having 1 to 20 carbon atoms.

In one embodiment, the amine may be a monoamine of formula (II) wherein $R_2$ is hydrogen and $R_3$ and $R_4$ are independently selected from a hydrocarbyl group with 1-20 carbon atoms, or from 2 to 18 carbon atoms, or from 4 to 16 carbon atoms. In another embodiment, $R_2$ and $R_3$ are hydrogen and $R_4$ is a hydrocarbyl group with 1-20 carbon atoms. In preferred embodiments, the total number of carbon atoms from $R_2$, $R_3$, and $R_4$ is at least 8 carbon atoms. Particularly suitable hydrocarbyl groups may be linear or branched alkyl groups.

In one aspect, monoamines of the formula (II) may include a primary, secondary tertiary amino group.

In another embodiment, the amine may be an amine of the formula (III):

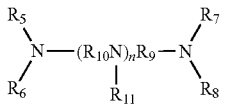

(III)

wherein $R_5$, $R_6$, $R_7$, $R_8$, and $R_{11}$ are each independently selected from hydrogen and a hydrocarbyl group containing from 1 to 160 carbon atoms, $R_9$ and $R_{10}$ are independently selected from hydrocarbylene groups containing from 2 to 20 carbon atoms; n is an integer from 0 to 20 and when n>1, each $R_{10}$ can be the same or different and each $R_{11}$ can be the same or different. In another embodiment n=0.

In another aspect, the amine of the formula (III) may be a polyamine wherein $R_5$, $R_6$, $R_7$, $R_8$, and $R_{11}$ are each independently selected from hydrogen and a hydrocarbyl group containing from 1 to 160 carbon atoms; $R_9$ and $R_{10}$ are independently selected from hydrocarbylene groups containing from 2 to 20 carbon atoms; n is an integer from 1 to 20; when n>1, each $R_{10}$ can be the same or different and each $R_{11}$ can be the same or different.

In another embodiment, n is an integer from 1 to 20 and $R_{11}$ is a hydrocarbyl substituted with an amino group. The polyamines of Formula (III) include at least two amino groups and may include at least one of a primary, secondary, and tertiary amino group, or mixtures thereof.

In another embodiment, the nitrogen containing compound may be a hydrocarbyl-substituted succinimide, wherein the hydrocarbyl-substituted succinimide comprises at least one amine group. Preferably, the hydrocarbyl-substituted succinimide is selected from the group consisting of mono-alkenylsuccinimides, bis-alkenyl succinimides, and polyisobutylene succinimides.

The hydrocarbyl-substituted succinimide may be prepared by reacting a hydrocarbyl-dicarboxylic acid or anhydride and a polyamine. The hydrocarbyl moiety of the hydrocarbyl-dicarboxylic acid or anhydride refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

In a preferred embodiment, the hydrocarbyl moiety of the hydrocarbyl-dicarboxylic acid or anhydride may be derived from alkenes, for example butene polymers such as isobutylene. Suitable polyisobutenes for use herein include those formed from polyisobutylene or highly reactive polyisobutylene having at least 60%, such as 70% to 90% and above, terminal vinylidene content. Suitable polyisobutenes may include those prepared using $BF_3$ catalysts. The average number molecular weight of the polyalkenyl substituent may vary over a wide range, for example from 100 to 5000, such as from 500 to 5000, as determined by gel permeation chromatography (GPC) as described above.

The dicarboxylic acid or anhydride of may be selected from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of the dicarboxylic acid or anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of dicarboxylic acid or anhydride to hydrocarbyl moiety is from 1:1 to less than 1.6:1.

Any of numerous polyamines can be used to prepare the hydrocarbyl substituted succinimide. Non-limiting exemplary polyamines may include aminoguandine bicarbonate (AGBC), diethylene triamine (DETA), triethylene tetramine 9TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the hydrocarbyl substituted succinimide may be prepared from a $C_9$-$C_{20}$ alkenyl succinic anhydride and a polyamine, for example, octadecenyl succinic anhydride and tetraethylenepentamine. In another embodiment, the hydrocarbyl-substituted succinimides include alkenyl succinimides and polyisobutylene succinimides.

Suitable amines include aliphatic polyamines, such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, bis-2-ethylhexyl amine, polyamine still bottoms, dipropylene triamine, di-(1-2-butylene)triamine, tetra-(1,2-propylene)pentamine), and mixtures thereof. Polyamine still bottoms are sold under the tradename E100™. Other suitable amines are 2-ethyl hexylamine, dibutylamine, tributylamine, trioctylamine and $C_9$-$C_{20}$ branched primary amines such as Primene™ 81-R, a primary aliphatic amine with highly branched alkyl chains. Such aliphatic polyamines have a primary amine group at each end so they may form mono-alkenylsuccinimides and bis alkenylsuccinimides. Other suitable amines include $C_9$-$C_{15}$ primary amines having at tertiary alkyl group therein. Commercially available ethylene polyamine mixtures may contain minor amounts of branched species and cyclic species such as N-aminoethyl piperazine, N,N'bis (aminoethyl)piperazine, N,N'-bis(piperazinyl)ethane, $C_9$-$C_{20}$ branched primary amines (such as Primene™ 81-R), and similar compounds.

Preferably, a molar ratio of the acid phosphate component to the nitrogen containing compound of from 0.2:0.8, or from 0.4:0.7, is employed to make the reaction product. In some cases, it may be desirable to minimize the unreacted acid phosphate in the lubricating composition by employing a molar excess of nitrogen containing compound to produce the reaction product.

Oil Soluble Hydrocarbyl Borate

The oil soluble hydrocarbyl borate (c) of the present disclosure may be represented by the formula (IV):

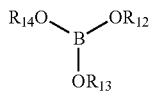

(IV)

wherein $R_{12}$, $R_{13}$, and $R_{14}$ are each independently selected from a hydrocarbon group containing from 1 to 20 carbon atoms, and wherein the hydrocarbyl borate of the formula (IV) contains at least 6 carbon atoms. Preferably, each hydrocarbon group may be linear, branched, saturated, and unsaturated. Suitable hydrocarbon groups may include, but are not limited to alkyl groups, aryl groups, alkylaryl groups, arylalkyl groups. Particularly suitable hydrocarbon groups may be linear or branched alkyl groups. In some embodiments, $R_{12}$, $R_{13}$, and $R_{14}$ are independently selected from linear alkyl, branched, alkyl, and cycloalkyl groups.

Suitable hydrocarbyl borates include tri-alkyl borates, such as triethyl borate, tripropyl borate, tri-isopropyl borate, tributyl borate, tri-s-butyl borate, tri-isobutyl borate, tri-t-butyl borate, triamyl borate, trihexyl borate, triphenyl borate, tribenzyl borate, and the like.

The oil soluble hydrocarbyl borate is present in an amount to contribute from 5 ppm to 400 ppm of boron, or from 55 ppm to 375 ppm of boron, based on the total weight of the lubricating oil composition. The lubricating oil compositions herein may have a molar ratio of moles of phosphorus contributed from component b) to moles of boron contributed from component c) of from 1:1 to 10:1 or from 1.3:1 to 6:1, or from 1.4:1 to 5.75:1.

Friction Modifiers

Another component that can be added to the transmission fluid composition is a friction modifier. Friction modifiers are used in the transmission fluid compositions as described herein to decrease or increase friction between surfaces (e.g., the members of a torque converter clutch or a shifting clutch) at low sliding speeds. Typically, the desired result is a friction-vs.-velocity (μ-v) curve that has a positive slope, which in turn leads to smooth clutch engagements minimizing "stick-slip" behavior (e.g., shudder, noise, and harsh shifts).

Friction modifiers include such compounds as aliphatic amines or ethoxylated aliphatic amines, ether amines, alkoxylated ether amines, sarcosine compounds, aliphatic fatty acid amides, acylated amines, aliphatic carboxylic acids, aliphatic carboxylic esters, polyol esters, aliphatic carboxylic ester-amides, imidazolines, tertiary amines, aliphatic phosphonates, aliphatic phosphates, aliphatic thiophosphonates, aliphatic thiophosphates, etc., wherein the aliphatic group usually contains one or more carbon atoms so as to render the compound suitably oil soluble. As a further example, the aliphatic group may contain 8 or more carbon atoms. Also suitable are aliphatic substituted succinimides formed by reacting one or more aliphatic succinic acids or anhydrides with ammonia primary amines.

The friction modifier is desirably present in the transmission fluid composition in an amount that is sufficient to provide from 50 to 800 ppm, and desirably from 150 to 500 ppm by weight nitrogen to the transmission fluid composition based on a total weight of the lubricating composition.

Other friction modifier compounds may also be included in the transmission fluid compositions described herein. For example, one group of friction modifiers includes the N-aliphatic hydrocarbyl-substituted diethanol amines in which the N-aliphatic hydrocarbyl-substituent is at least one straight chain aliphatic hydrocarbyl group free of acetylenic unsaturation and having in the range of 14 to 20 carbon atoms.

Another friction modifier that may be used is based on a combination of (i) at least one di(hydroxyalkyl) aliphatic tertiary amine in which the hydroxyalkyl groups, being the same or different, each contain from 2 to 4 carbon atoms, and in which the aliphatic group is an acyclic hydrocarbyl group containing from 10 to 25 carbon atoms, and (ii) at least one hydroxyalkyl aliphatic imidazoline in which the hydroxyalkyl group contains from 2 to 4 carbon atoms, and in which the aliphatic group is an acyclic hydrocarbyl group containing from 10 to 25 carbon atoms. For further details concerning this friction modifier system, reference should be made to U.S. Pat. No. 5,344,579.

Generally speaking, the transmission fluid composition described herein may suitably contain up to 2.5 wt. %, desirably from 0.05 wt. % to 2.2 wt. %, and preferably up to 1.8 wt. %, or up to only 1.25 wt. %, or, as a further example, most preferably from 0.75 to 1 wt. % of one or more total friction modifiers in the transmission fluid composition.

Other Optional Components

The transmission fluid composition described herein may also include conventional additives of the type used in automatic transmission fluid compositions in addition to the components described above. Such additives include, but are not limited to, dispersant additive, detergent additive, antioxidants, corrosion inhibitors, antirust additives, metal deactivators, antifoamants, pour point depressants, air entrainment additives, seal swell agents, and the like.

Dispersants

A dispersant additive that may be used may be a reaction product of a hydrocarbyl-dicarboxylic acid or anhydride and a polyamine. The hydrocarbyl moiety of the hydrocarbyl-dicarboxylic acid or anhydride of may be derived from butene polymers, for example polymers of isobutylene. Suitable polyisobutenes for use herein include those formed from polyisobutylene or highly reactive polyisobutylene having at least 60%, such as 70% to 90% and above, terminal vinylidene content. Suitable polyisobutenes may include those prepared using $BF_3$ catalysts. The average number molecular weight of the polyalkenyl substituent may vary over a wide range, for example from 100 to 5000, such as from 500 to 5000, as determined by gel permeation chromatography (GPC) as described above.

The dicarboxylic acid or anhydride of may be selected from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of maleic anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of anhydride to hydrocarbyl moiety is from 1:1 to less than 1.6:1.

Any of numerous polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. In an embodiment of the disclosure, the polyamine may be selected from tetraethylene pentamine (TEPA).

In an embodiment, the dispersant additive may be compounds of Formula (V):

(V)

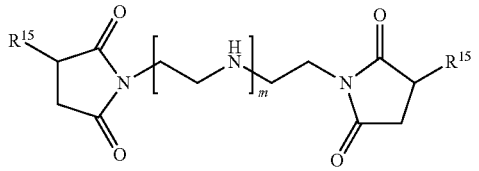

wherein m represents 0 or an integer of from 1 to 5, and $R^{15}$ is a hydrocarbyl substituent as defined above. In an embodiment, m is 3 and $R^{15}$ is a polyisobutenyl substituent, such as that derived from polyisobutylenes having at least 60%, such as 70% to 90% and above, terminal vinylidene content. Compounds of Formula (V) may be the reaction product of a hydrocarbyl-substituted succinic anhydride, such as a polyisobutenyl succinic anhydride (PIBSA), and a polyamine, for example tetraethylene pentamine (TEPA).

The foregoing compound of Formula (V) may have a molar ratio of (A) polyisobutenyl-substituted succinic anhydride to (B) polyamine in the range of 4:3 to 1:10 in the compound. A particularly useful dispersant contains polyisobutenyl group of the polyisobutenyl-substituted succinic anhydride having a number average molecular weight (Mn) in the range of from 500 to 5000 as determined by GPC and a (B) polyamine having a general formula $H_2N(CH_2)_x$—$[NH(CH_2)_x]_y$—$NH_2$, wherein x is in the range from 2 to 4 and y is in the range of from 1 to 2.

In some embodiments, the dispersant may be an ashless dispersant. In some embodiments, the lubricating composition may further comprise a minor amount of an ashless dispersant that is boronated and/or phosphorylated. Accordingly, in one embodiment, the dispersant additive has a nitrogen content of up to 10,000 ppm by weight, for example from 0.5 to 0.8 wt. % and a boron plus phosphorus to nitrogen ((B+P)/N) weight ratio of from 0:1 to 0.8:1. The amount of dispersant in the lubricating composition may range from 300 to 1000 ppm by weight for example, and more preferably, from 400 to 900 ppm by weight in terms of nitrogen based on a total weight of the lubricating composition.

Metal Detergents

Metal detergents that may be included in the lubricating compositions described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates).

Suitable detergent substrates include phenates, calixarates, salixarates, salicylates, carboxylic acids, phosphorus acids, alkyl phenols, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. More than one metal may be present, for example, both calcium and magnesium. Mixtures of calcium and/or magnesium with sodium may also be suitable.

Examples of suitable detergents include, but are not limited to, calcium phenates, calcium calixarates, calcium salixarates, calcium salicylates, calcium carboxylic acids, calcium phosphorus acids, calcium alkyl phenols, calcium methylene bridged phenols, magnesium phenates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art. The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 130 mg KOH/gram or greater, or as further examples, about 150 mg KOH/gram or greater, or about 200 mg KOH/gram or greater, or about 250 mg KOH/gram or greater, or about 300 mg KOH/gram or greater, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

Specific examples of suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The overbased detergent may have a metal to substrate ratio of from 1.1:1, or from 2:1, or from 4:1, or from 5:1, or from 7:1, or from 10:1.

The metal-containing detergent may be present in a lubricating composition in an amount sufficient to improve the anti-rust performance of the lubricating composition. For example, the amount of detergent in the lubricating composition may range from 0.5 wt. % to 5 wt. %. As a further example, the metal-containing detergent may preferably be present in an amount of from 1.0 wt. % to 3.0 wt. %. The metal-containing detergent may be present in a lubricating composition in an amount sufficient to provide from 10 to 5000 ppm alkali and/or alkaline earth metal based on a total weight of the lubricating composition. As a further preferred example, the metal-containing detergent may be present in the lubricating composition in an amount sufficient to provide from 40 to 900 ppm alkali and/or alkaline earth metal. A particularly preferred amount of detergent in the lubricating composition may provide from 60 to 600 ppm of alkali and/or alkaline earth metal to the lubricating composition.

Corrosion Inhibitors

Rust or corrosion inhibitors may also be included in the lubricating compositions described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Mixtures of such rust or corrosion inhibitors may be used. The total amount of corrosion inhibitor, when present in the lubricating composition described herein may range up to 5.0 wt. % or from 0.01 to 2.0 wt. % based on the total weight of the lubricating composition.

Antioxidants

In some embodiments, antioxidant compounds may be included in the lubricating composition described herein. Antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol). N,N'-di-sec-butyl-phenylenediamine, 4-isopropylaminodiphenylamine, phenyl-.alpha.-naphthyl amine, phenyl-.alpha.-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

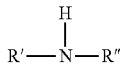

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenyl amines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricating composition is based on the sulfur content of the sulfurized olefin or fatty oil and the desired level of sulfur to be delivered to the finished lubricating composition. For example, a sulfurized fatty oil or olefin containing 20 weight % sulfur, when added to the finished lubricating composition at a 1.0 weight % treat level, will deliver 2000 ppm of sulfur to the finished lubricating composition. A sulfurized fatty oil or olefin containing 10 weight % sulfur, when added to the finished lubricating composition at a 1.0 weight % treat level, will deliver 1000 ppm sulfur to the finished lubricating composition. It is desirable that the sulfurized olefin or sulfurized fatty oil to deliver between 200 ppm and 2000 ppm sulfur to the finished lubricating composition. The total amount of antioxidant in the lubricating compositions described herein may range from 0.01 to 3.0 wt. % based on the total weight of the lubricating composition. As a further example, antioxidant may be present in a preferred amount of from 0.1 wt. % to 1.0 wt. %.

Extreme Pressure Agents

The lubricant composition may optionally contain one or more extreme pressure agents. Extreme Pressure agents that are soluble in the oil include sulfur- and chlorosulfur-containing extreme pressure agents, chlorinated hydrocarbon EP agents and phosphorus EP agents. Examples of such EP agents include chlorinated waxes; organic sulfides and polysulfides such as sulfurized polyisobutylene, sulfurized fatty acids, dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof. Preferred extreme pressure agents are sulfurized polyisobutylene and sulfurized fatty acids.

The extreme pressure agent, when present in the lubricant composition may be present in amount up to 10 wt. % or the lubricant composition may contain from 0.001 to 2 wt. %, preferably from 0.01 to 0.3 wt. %, more preferably from 0.02 to 0.15 wt. %, most preferably from 0.03 to 0.1 wt. % of extreme pressure agents based on the total weight of the lubricant composition.

Seal Swell Agents

The lubricating composition described herein may optionally contain seal swell agents such as alcohols, alkylbenzenes, substituted sulfolanes or mineral oils that cause swelling of elastomeric materials. Alcohol-type seal swell agents are low volatility linear alkyl alcohols. Examples of suitable alcohols include decyl alcohol, tridecyl alcohol and tetradecyl alcohol. Examples of alkylbenzenes useful as seal swell agents for use in conjunction with the compositions described herein include dodecylbenzenes, tetradecylbenzenes, dinonyl-benzenes, di(2-ethylhexyl)benzene, and the like. Examples of substituted sulfolanes are described in U.S. Pat. No. 4,029,588, incorporated herein by reference. Mineral oils useful as seal swell agents are typically low viscosity mineral oils with high naphthenic or aromatic content. When used in the lubricating composition described herein, a seal swell agent will comprise from 1 to 30 wt. %, preferably from 2 to 20 wt. %, most preferably from 5 to 15 wt. %, based on the total weight of the lubricating composition.

Anti-Foam Agents

In some embodiments, a foam inhibitor may form another component suitable for use in the lubricating compositions described herein. Foam inhibitors may be selected from silicones, polyacrylates, and the like. When present, the amount of antifoam agent in the lubricating compositions described herein may range up to 1.0 wt. %, or from 0.001 wt. % to 0.1 wt. % based on the total weight of the lubricating composition. As a further example, antifoam agent may be present in a preferred amount of from 0.004 wt. % to 0.10 wt. %.

Viscosity Index Improvers

The lubricant composition may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The lubricant composition herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver, when present, may be up to 30 wt. %, or may be from 0.001 wt. % to 25 wt. %, or 0.01 wt. % to 20 wt. %, or 0.1 wt. % to 15 wt. %, or 0.1 wt. % to 8 wt. %, or 0.5 wt. % to 5 wt. % based on the total weight of the lubricant composition.

Pour Point Depressant

The lubricant composition may optionally contain one ore more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from 0.001 wt. % to 1 wt. %, or 0.01 wt. % to 0.5 wt. %, or 0.02 wt. % to 0.04 wt. %, based upon the total weight of the lubricant composition.

In one embodiment the lubricant composition may comprise one or more demulsifying agents, such as trialkyl phosphates, polyethylene glycols, polyethylene oxides, polypropylene oxides and (ethylene oxide-propylene oxide) polymers.

Additives used in formulating the lubricating compositions described herein can be blended into the base oil individually or in various sub-combinations. However, it is suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

In general terms, a suitable lubricating composition may include additive components in the ranges listed in the following Table 2:

TABLE 2

| Component | Wt. % (Suitable Embodiments) | Wt. % (Preferred Embodiments) |
|---|---|---|
| Amine Salt of Acid Phosphate | 0.1-10.0 | 0.5-5.0 |
| Hydrocarbyl Borate | 0.01-5.0 | 0.05-2.0 |
| Dispersant(s) | 0.5-20.0 | 1.0-15.0 |
| Antioxidant(s) | 0-2.0 | 0.01-1.0 |
| Metal Detergent(s) | 0.1-10.0 | 0.5-5.0 |
| Corrosion inhibitor(s) | 0.0-5.0 | 0.1-2.0 |
| Extreme Pressure/Antiwear Agent(s) | 0.0001-10 | 0.01-2.0 |
| Antifoaming agent(s) | 0.0-1.0 | 0.001-0.1 |
| Friction Modifier(s) | 0-2.0 | 0.05-1.0 |
| Viscosity index improver(s) | 0.0-30.0 | 0.1-8 |
| Pour point depressant(s) | 0.001-1.0 | 0.01-0.5 |
| Seal swell agent(s) | 0-10.0 | 0.5-5.0 |
| Base oil(s) | Balance | Balance |
| Total | 100 | 100 |

The percentages of each component above represent the weight percent of each component, based upon the total weight of the final lubricating oil composition containing the recited component. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

The lubricant compositions disclosed herein may be transmission fluids, gear oils or axle lubricants. Thus, the disclosure also encompasses such transmission fluids, gear oils and axle lubricants.

Particularly advantageous applications of the invention would be in electrical and hybrid electrical vehicle technology. Electrical and hybrid vehicles have a need for strong protection of gears from scuffing damage. Also, electrical and hybrid vehicles tend to employ more sophisticated electronic materials and seals which can be readily damaged by commonly used sulfur-containing anti-wear and extreme pressure agents.

Also disclosed herein are methods for reducing gear scuffing in a transmission or gear including a step of lubricating the transmission or gear with the lubricating oil composition described above. Also within the scope of this disclosure are methods of operating a transmission including steps of lubricating said transmission with the lubricating oil composition described herein and operating the transmission.

The invention also relates to the use of the lubricating oil compositions described herein for lubrication of transmissions, gears and axles as well as to the use of the lubricating oil compositions described herein for reducing gear scuffing in a transmission or gear.

EXAMPLES

The following examples are illustrative, but not limiting, of the methods and compositions of the present disclosure. In the following Examples, the impact on gear scuffing of the incorporation of an amine salt of an acid phosphate into a transmission fluid composition was determined.

Table 3 summarizes the compositions of Comparative Examples CE1-CE5 and Inventive Examples 1-4. Table 4 summarizes the components used in Inventive Examples 5-8.

Reaction Product of a Nitrogen Containing Compound and a Hydrocarbyl Acid Phosphate A-1: a reaction product of amyl acid phosphate, having a phosphorus content of 15.0%, and bis-(2-ethylhexyl) amine with a weight ratio of amyl acid phosphate to amine of 0.64

A-2: Methyl acid phosphate salted with a branched primary amine, the salted component having a phosphorus content of 9.5%.

A-3: Mixture of di-hexyl and mono-hexyl phosphate salted with a $C_{12}$-$C_{14}$ dialkyl and a trialkyl amine, the salted component having a phosphorus content of 4.8% and having a weight ratio of phosphate to amine of approximately 0.5.

A-4: an alkenyl succinimide reaction product made by reacting octadecenyl succinic anhydride and tetraethylenepentamine (TEPA) in a molar ratio of 2, which is then reacted with amyl acid phosphate, having a phosphorus content of 15.0%; the weight ratio of amyl acid phosphate to the alkenyl succinimide reaction product is 0.44, except as otherwise noted in the table.

Oil Soluble Hydrocarbyl Borates

B-1: tributyl borate, having 4.7% B.

B-2: triethyl borate, having 7.4% B.

Dispersants

D-1: PIBSA-polyamine dispersant with a 950 MW PIB group

D-2: Phosphorylated and borated PIBSA-polyamine dispersant with a 950

MW PIB group, having 0.76% P and 0.35% B.

Base Oil

Each of the following Examples comprises a mixture of Group IV and V base oils.

TABLE 3

| | | CE1 | CE2 | CE3 | CE4 | CE5* | 1 | 2 | 3 | 4 |
|---|---|---|---|---|---|---|---|---|---|---|
| Amine salt of an acid phosphate | 1 | — | 3.35 | — | — | 1.70 | 1.70 | 1.70 | — | — |
| | 2 | 1 | — | — | — | — | — | — | 1 | — |
| | 3 | — | — | — | — | — | — | — | — | 0.83 |
| Oil soluble Hydrocarbyl Borate | 1 | — | — | 0.25 | 0.25 | — | 0.25 | 0.25 | 0.5 | — |
| | 2 | — | — | — | — | — | — | — | — | 0.094 |
| Dispersant | 1 | — | — | — | 2.0 | 2.0 | — | 2.0 | 2.0 | 2.0 |
| Boron from component c), ppm | | — | — | 96 | 124 | — | 61 | 118 | 222 | 69 |
| Phosphorus from component b), ppm | | 941 | 1930 | — | — | 976 | 959 | 988 | 922 | 372 |
| Mole ratio of Phosphorus to Boron from components b) and c) | | — | — | — | — | — | 5.49 | 2.92 | 1.45 | 1.88 |
| Failure Load Stage, (FLS) | | 3 | 4 | 4 | 3 | 5 | 6 | 7 | 6 | 7 |

*CE5 also contained 0.36 wt % of a 300 TBN calcium sulphonate detergent containing 11.9% calcium.

TABLE 4

| | | 5 | 6 | 7 | 8 |
|---|---|---|---|---|---|
| Amine salt of an acid phosphate | 1 | 1.70 | — | — | — |
| | 2 | — | — | — | |
| | 3 | — | — | — | — |
| | 4 | — | 2.17 | 3.25 | 1.0 |
| Oil soluble Hydrocarbyl Borate | 1 | 0.25 | 0.49 | 0.74 | 0.075 |
| Dispersant | 1 | 2.0 | — | — | — |
| | 2 | 4.0 | 4 | 4 | 4 |
| Weight ratio of amyl acid phosphate to the nitrogen-containing compound to make the amine salt of the acid phosphate | | 0.64 | 0.44 | 0.44 | 0.5 |
| Calculated Boron from component c), ppm | | 118 | 230 | 348 | 35.3 |
| Calculated Phosphorus from component b), ppm | | 1000 | 1000 | 1500 | 500 |
| Calculated mole ratio of Phosphorus to Boron from components b) and c) | | 2.94 | 1.49 | 2.27 | 4.96 |
| Total Phosphorus in fluid, ppm | | 1214 | 1310 | 1760 | 797 |
| Total Boron in fluid, ppm | | 260 | 378 | 461 | 180 |
| Failure Load Stage, (FLS) | | 6 | 7 | 7 | 7 |

The transmission fluids of Comparative Examples CE1-CE5 and inventive examples 1-8 were tested using the CEC L-84-02 to evaluate gear scuffing. This test measures anti-scuffing properties of oil for reduction gears, hypoid gears, automatic transmission gears and the like. The test uses a FZG A10-type pinion with a width of 10 mm, and a wheel width of 20 mm. The motor is run at a wheel rotational speed of 2880 rpm and a circumferential speed of 16.6 m/s for a total run duration of 7 minutes and 30 seconds at an initial lubricant oil temperature of 90° C. The results reported include load stage failure. Typically, better results are obtained for lubricants reporting a higher load stage failure.

In Table 3, Inventive Examples 1-4 demonstrate that a lubricating composition comprising the combination of an amine salt of an acid phosphate and an oil soluble hydrocarbyl borate provides a significant improvement in the results of the FZG test as compared to similar lubricating compositions of Comparative Examples CE1-CE5 comprising only one of the amine salt of an acid phosphate and the borate.

In Table 3, CE5 is the only example which additionally comprised 0.36 wt. % of an overbased calcium sulphonate, which provided a moderate Failure Load Stage boost from 3 to 5, when compared to the formulation of CE4. However, Inventive Example 2 demonstrates that the combination of the amine salt of the acid phosphate and the borate provided a significant boost in the FLS rating, while eliminating the need for a calcium sulfonate detergent.

In Table 4, Inventive Examples 5-8 each contained an amine salt of an acid phosphate, an oil soluble hydrocarbyl borate, and a phosphorylated and borated PIBSA-polyamine dispersant. Inventive Examples 5-8 also demonstrate a significant boost in the FLS rating.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

At numerous places throughout this specification, reference has been made to various documents. All such cited documents are expressly incorporated in full into this disclosure as if fully set forth herein.

It is to be understood that each component, compound, substituent or parameter disclosed herein is to be interpreted as being disclosed for use alone or in combination with one or more of each and every other component, compound, substituent or parameter disclosed herein.

It is also to be understood that each amount/value or range of amounts/values for each component, compound, substituent or parameter disclosed herein is to be interpreted as also being disclosed in combination with each amount/value or range of amounts/values disclosed for any other component (s), compounds(s), substituent(s) or parameter(s) disclosed herein and that any combination of amounts/values or ranges of amounts/values for two or more component(s), compounds(s), substituent(s) or parameters disclosed herein are thus also disclosed in combination with each other for the purposes of this description.

It is further understood that each range disclosed herein is to be interpreted as a disclosure of each specific value within the disclosed range that has the same number of significant digits. Thus, a range of from 1-4 is to be interpreted as an express disclosure of the values 1, 2, 3 and 4.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A lubricating oil composition comprising:

a) greater than 50 wt. % of a base oil;

b) 0.01 wt. % to 10 wt. % of a reaction product of a hydrocarbyl acid phosphate of the formula (I), based on the total weight of the lubricating oil composition:

(I)

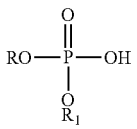

wherein R is a hydrocarbyl group having 1 to 20 carbon atoms and $R_1$ is selected from hydrogen and a hydrocarbyl group having 1 to 20 carbon atoms, and a nitrogen containing compound selected from:

i) an oil soluble amine of the formula (II):

(II)

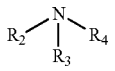

wherein $R_2$ and $R_3$ are each independently selected from hydrogen or a hydrocarbyl group having from 1 to 20 carbon atoms, and $R_4$ is a hydrocarbyl group having 1 to 20 carbon atoms; and ii) an oil soluble amine of the formula (III):

(III)

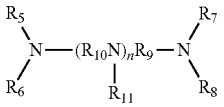

wherein $R_5$, $R_6$, $R_7$, $R_8$, and $R_{11}$ are each independently selected from hydrogen and a hydrocarbyl group containing from 1 to 160 carbon atoms;

$R_9$ and $R_{10}$ are independently selected from hydrocarbylene groups containing from 2 to 20 carbon atoms; n is an integer of from 0 to 20 and when n>1, each $R_{10}$ can be the same or different and each $R_{11}$ can be the same or different; and iii) a hydrocarbyl-substituted succinimide;

c) an oil soluble hydrocarbyl borate of the formula (IV):

(IV)

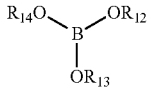

wherein $R_{12}$, $R_{13}$, and $R_{14}$ are each independently selected from a hydrocarbon group containing from 1 to 20 carbon atoms, and wherein the hydrocarbyl borate of the formula (IV) contains at least 6 carbon atoms, wherein a molar ratio of moles of phosphorus contributed by component b) to moles of boron contributed by component c) is from 1:1 to 10:1.

2. The lubricating oil composition of claim 1, wherein a molar ratio of moles of phosphorus contributed by component b) to moles of boron contributed by component c) is from 1.3:1 to 6:1.

3. The lubricating oil composition of claim 1, wherein a molar ratio of moles of phosphorus contributed by component b) to moles of boron contributed by component c) is from 1.4:1 to 5.75:1.

4. The lubricating oil composition of claim 1, wherein $R_{12}$, $R_{13}$, and $R_{14}$ are independently selected from linear alkyl, branched, alkyl, and cycloalkyl.

5. The lubricating oil composition of claim 1, wherein the hydrocarbyl acid phosphate is employed to make component (b) in an amount of from 0.01 wt. % to 5 wt. %, based on the total weight of the lubricating oil composition.

6. The lubricating oil composition of claim 1, wherein the hydrocarbyl acid phosphate is employed to make component (b) in an amount of from 0.1 wt. % to 2 wt. %, based on the total weight of the lubricating oil composition.

7. The lubricating oil composition of claim 1, wherein the hydrocarbyl borate (c) is selected from triethyl borate and tributyl borate.

8. The lubricating oil composition of claim 1, wherein the hydrocarbyl acid phosphate is selected from the group consisting of amyl acid phosphate, methyl acid phosphate, hexyl acid phosphate, and 2-ethyl hexyl acid phosphate.

9. The lubricating oil composition of claim 1, wherein the hydrocarbyl acid phosphate is selected from the group consisting of amyl acid phosphate, methyl acid phosphate, and hexyl acid phosphate.

10. The lubricating oil composition of claim 1, wherein the nitrogen containing compound is an amine of the formula (II) and contains at least 8 carbon atoms.

11. The lubricating oil composition of claim 1, wherein the reaction product (b) is present in an amount of from 0.1 wt. % to 5 wt. %.

12. The lubricating oil composition of claim 1, wherein the reaction product (b) is present in an amount of from 0.5 wt. % to 4 wt. %.

13. The lubricating oil composition of claim 1, wherein the reaction product (b) is present in an amount of from 0.75 wt. % to 3.75 wt. %.

14. The lubricating oil composition of claim 1, wherein component b) is present in an amount to contribute from 50 ppm to 1500 ppm of phosphorus, based on the total weight of the lubricating oil composition.

15. The lubricating oil composition of claim 1, wherein component b) is present in an amount to contribute from 300 to 1500 ppm phosphorus, based on a total weight of the lubricating oil composition.

16. The lubricating oil composition of claim 1, wherein component b) is present in an amount to contribute from 900 to 1200 ppm phosphorus, based on a total weight of the lubricating oil composition.

17. The lubricating oil composition of claim 1, wherein component c) is present in an amount to contribute from 5 ppm to 400 ppm of boron, based on the total weight of the lubricating oil composition.

18. The lubricating oil composition of claim 1, wherein component c) is present in an amount to contribute from 55 ppm to 375 ppm of boron, based on the total weight of the lubricating oil composition.

19. The lubricating oil composition of claim 1, wherein a molar ratio of the acid phosphate component to the nitrogen containing compound of from 0.2:0.8 is employed to make the component b).

20. The lubricating oil composition of claim 1, wherein a molar ratio of the acid phosphate component to the nitrogen containing compound of from 0.4:0.7 is employed to make the component b).

21. The lubricating oil composition of claim 1, wherein R is a hydrocarbyl group comprising from 1 to 10 carbon atoms and $R_1$ is selected from hydrogen and a hydrocarbyl group comprising from 1 to 10 carbon atoms.

22. The lubricating oil composition of claim 1, wherein R is a hydrocarbyl group comprising from 1 to 6 carbon atoms, and $R_1$ is selected from hydrogen and a hydrocarbyl group comprising from 1 to 10 carbon atoms.

23. The lubricating oil composition of claim 1, wherein R is a hydrocarbyl group having from 1 to 6 carbon atoms and $R_1$ is hydrogen.

24. The lubricating oil composition of claim 1, wherein the nitrogen containing compound is an amine of the formula (II) wherein $R_2$ is hydrogen.

25. The lubricating oil composition of claim 1, wherein the nitrogen containing compound is an amine of the formula (II) wherein $R_2$ and $R_3$ are hydrogen.

26. The lubricating oil composition of claim 1, wherein the nitrogen containing compound is an amine of the formula (III), n=0, and $R_9$ is a hydrocarbylene group comprising from 2 to 20 carbon atoms.

27. The lubricating oil composition of claim 1, wherein the nitrogen containing compound is an amine of the formula (III), n is from 2 to 5, $R_5$-$R_8$ and $R_{11}$ are hydrogen, and $R_9$ and $R_{10}$ are hydrocarbylene groups comprising 2 carbon atoms.

28. The lubricating oil composition of claim 1, wherein the nitrogen containing compound is selected from component iii) and is selected from the group consisting of mono-alkenylsuccinimides, bis-alkenylsuccinimides, and polyisobutylene succinimides.

29. The lubricating oil composition of claim 28, wherein the nitrogen containing compound is a mono-alkenylsuccinimide prepared by reacting an octadecenyl succinic anhydride and tetraethylenepentamine.

30. The lubricating oil composition of claim 1, wherein the base oil is selected from a Group IV base oil, a Group V base oil and a mixture of a Group IV base oil and a Group V base oil.

31. The lubricating oil composition of claim 1, further comprising an ashless dispersant.

32. The lubricating oil composition of claim 31, wherein the ashless dispersant is borated and/or phosphorylated.

33. The lubricating oil composition of claim 1, further comprising one or more of the optional components selected from the group consisting of detergents, corrosion inhibitors, antioxidants, viscosity modifiers and friction modifiers.

34. The lubricating oil composition of claim 1, wherein the lubricating composition is a transmission fluid.

35. The lubricating oil composition of claim 1, wherein the lubricating oil composition is a gear oil.

36. A method for reducing gear scuffing in a transmission comprising a step of lubricating said transmission with the lubricating oil composition as claimed in claim 1.

* * * * *